US006820610B2

(12) United States Patent
Wright

(10) Patent No.: US 6,820,610 B2
(45) Date of Patent: Nov. 23, 2004

(54) FIREPLACE GRATE ACCESSORY TO INCREASE BURN TIME OF SYNTHETIC LOG

(76) Inventor: Stanley G. Wright, 8745 Skiles Pl., Indianapolis, IN (US) 46234

( * ) Notice: Subject to any disclaimer, the term of this patent is extended or adjusted under 35 U.S.C. 154(b) by 17 days.

(21) Appl. No.: 10/090,993

(22) Filed: Mar. 4, 2002

(65) Prior Publication Data

US 2002/0129810 A1 Sep. 19, 2002

Related U.S. Application Data

(60) Provisional application No. 60/276,014, filed on Mar. 15, 2001.

(51) Int. Cl.[7] ..... F23H 1/00; F24B 1/193

(52) U.S. Cl. ..... 126/540; 126/152 B; 126/163 A

(58) Field of Search ..... 126/540, 541, 126/500, 152 B, 163 A, 152 R, 167, 168, 25 B, 9 B, 298; D23/398, 403, 407

(56) References Cited

U.S. PATENT DOCUMENTS

| | | | | | |
|---|---|---|---|---|---|
| 388,473 | A | * | 8/1888 | Bissell | 126/153 |
| 2,985,165 | A | * | 5/1961 | Peterson et al. | 126/541 |
| 3,439,667 | A | | 4/1969 | Stone | |
| 3,505,986 | A | | 4/1970 | Wood | |
| 3,670,714 | A | | 6/1972 | Eyges | |
| 3,682,158 | A | * | 8/1972 | Thomas | 126/540 |
| 3,756,218 | A | | 9/1973 | Simpson | |
| 3,771,511 | A | | 11/1973 | Dalquist | |
| 3,830,218 | A | | 8/1974 | Shelton | |
| D243,226 | S | | 2/1977 | Kerstetter | |
| 4,058,108 | A | | 11/1977 | Dalquist | |
| D247,343 | S | | 2/1978 | Smith | |
| D247,344 | S | | 2/1978 | Smith | |
| D247,414 | S | | 3/1978 | Watkins et al. | |
| D247,417 | S | | 3/1978 | Smith | |
| D247,418 | S | | 3/1978 | Mick | |
| D247,419 | S | | 3/1978 | Mick | |
| D248,487 | S | | 7/1978 | Taylor | |
| D248,818 | S | | 8/1978 | Dacey | |
| D249,011 | S | | 8/1978 | Jones et al. | |
| D253,027 | S | | 10/1979 | Whitaker | |
| 4,180,054 | A | | 12/1979 | Romero et al. | |
| D255,316 | S | | 6/1980 | Hillman | |
| D257,625 | S | | 12/1980 | Dent | |
| 4,261,323 | A | | 4/1981 | Horwinski | |
| 4,280,475 | A | * | 7/1981 | Truran | 126/541 |
| 4,305,375 | A | * | 12/1981 | George | 126/540 |
| 4,344,412 | A | | 8/1982 | Perrin | |
| D267,223 | S | | 12/1982 | Hassett et al. | |
| D267,464 | S | | 1/1983 | Hassett et al. | |
| D267,465 | S | | 1/1983 | Hassett et al. | |
| D267,466 | S | | 1/1983 | Hassett et al. | |
| 4,471,757 | A | * | 9/1984 | Rogers | 126/152 B |
| 4,526,159 | A | | 7/1985 | Vroome | |
| 4,569,437 | A | | 2/1986 | Doerges | |
| 4,574,774 | A | | 3/1986 | Wells | |
| 4,611,573 | A | * | 9/1986 | Newman | 126/153 |
| 4,723,534 | A | | 2/1988 | Little et al. | |
| D301,369 | S | | 5/1989 | Wilkening | |

(List continued on next page.)

FOREIGN PATENT DOCUMENTS

GB 152180 A * 10/1920

*Primary Examiner*—Josiah Cocks
(74) *Attorney, Agent, or Firm*—Woodard, Emhardt, Moriarty, McNett & Henry LLP

(57) ABSTRACT

An accessory for a conventional fireplace grate that is positioned on top of the fireplace grate and which supports a synthetic firelog thereon. The accessory provides better support for the synthetic log than the grate alone, and the firelog therefore burns longer than if it were placed on the fireplace grate without the accessory. The present invention provides a handy accessory that adapts fireplace grates that are designed primarily for real wood to adequately support synthetic logs.

10 Claims, 7 Drawing Sheets

U.S. PATENT DOCUMENTS

| | | | | |
|---|---|---|---|---|
| 4,892,088 | A | | 1/1990 | Vestal, Sr. |
| 4,955,362 | A | | 9/1990 | Underdown |
| D311,953 | S | | 11/1990 | Martinson |
| D321,558 | S | | 11/1991 | Vestal, Sr. |
| D340,973 | S | | 11/1993 | Wilkening |
| D345,416 | S | | 3/1994 | Steele et al. |
| 5,408,989 | A | | 4/1995 | Vestal, Sr. |
| D369,404 | S | | 4/1996 | Vestal, Sr. |
| D373,186 | S | | 8/1996 | Bain |
| 5,575,275 | A | * | 11/1996 | Gazaille ..... 126/540 |
| 5,636,624 | A | | 6/1997 | Cassidy |
| 5,722,389 | A | | 3/1998 | Cranberg |
| 5,722,390 | A | | 3/1998 | Hannebaum |
| D416,997 | S | | 11/1999 | Prouty |
| 6,435,172 | B1 | * | 8/2002 | Freemon ..... 126/152 B |

* cited by examiner

FIREPLACE GRATE ACCESSORY TO INCREASE BURN TIME OF SYNTHETIC LOG

RELATED APPLICATIONS

This application claims priority to U.S. provisional application Serial No. 60/276,014, filed Mar. 15, 2001

FIELD OF THE INVENTION

The present invention relates to fireplace grates and more particularly relates to conventional fireplace grates adapted to be used with synthetic firelogs.

BACKGROUND

Traditionally, sawdust produced by wood mills and wood product manufacturers was disposed of by burning or by hauling to landfills. Synthetic firelogs were created in the late 1960s when it was discovered that sawdust could be put to a more responsible use. Engineers determined that soft wood fiber had a very good absorbency and bonded well with petroleum wax. These same engineers discovered they could combine the sawdust with petroleum wax and extrude the mixture into a log-shaped form. The new extruded logs were designed for burning in residential fireplaces as an alternative to natural firewood.

Unfortunately, synthetic firelogs such as Duraflame® firelogs tend to soften and break apart while burning and need proper support to assure maximum burn time. Further undesirably, once the firelogs break apart, the flames typically become smaller, less uniform and therefore less attractive. Conventional "real wood" fireplace grates with parallel bars spaced greater than two to three inches do not provide adequate support for synthetic firelogs. Nonetheless, such firelogs are commonly burned on these grates, resulting in log breakage, flare-up and/or reduced burn time.

Thus, it is desirable to provide a fireplace grate or an accessory therefor to avoid the aforementioned problems.

SUMMARY OF THE INVENTION

The present invention provides an accessory for a conventional fireplace grate that is positioned on top of the grate and which supports a synthetic firelog thereon. The accessory provides better support for the synthetic log than the grate alone, and the firelog therefore burns longer than if it were placed on the fireplace grate without the accessory.

In one form thereof, the present invention provides a fireplace grate assembly. The assembly comprises a grate having substantially parallel spaced bars adapted for supporting a log. A plurality of legs extends downwardly from the spaced bars thereby supporting the grate away from a fireplace floor on which the grate is placed. An accessory in accordance with the invention rests on top of the grate. The accessory comprises two elongate members positioned across a portion of the parallel spaced bars, the elongate members being spaced apart and connected to one another by at least one connecting member.

In a preferred form, the elongate members are substantially parallel to one another. The connecting member comprises a pair of spaced bars disposed between the elongate members. The pair of spaced bars are substantially orthogonal to the elongate members.

In a further preferred form, the elongate members comprise cylindrical steel stock of diameter between ⅜ inches to ⅞ inches and whose centers are spaced apart between 2½ to 3½ inches. Further, the connecting member comprises a pair of spaced bars disposed between the elongate members, the pair of bars being substantially orthogonal to the elongate members and being formed from the same stock.

In another form thereof, the present invention provides a method a method of burning a synthetic firelog with a fireplace grate of the type having substantially parallel spaced bars adapted for supporting one or more natural logs, and a plurality of legs connected thereto and extending downwardly therefrom, thereby supporting the grate away from a fireplace floor on which the grate is placed. The method comprises positioning an accessory on top of and across a portion of the spaced bars of the grate, the accessory comprising two elongate members spaced apart and connected to one another by at least one connecting member. A synthetic firelog is then placed on top of the accessory, the firelog aligned substantially lengthwise with the accessory, thereby substantially sandwiching the accessory between the grate and the firelog. The firelog is then ignited, whereby the firelog burns longer without breaking apart than if the accessory were not used.

In a preferred form, the substantially parallel spaced bars of the grate are spaced at least 2 inches apart, more preferably at least 3 inches apart. Preferably, the log is positioned over and supported by the elongate members and the connecting member.

The advantage of the present invention is that it provides a low-cost, easy to use accessory for allowing synthetic logs to be used with conventional fireplace grates. The present invention addresses the problem of synthetic logs softening and breaking apart when burned on conventional fireplace grates. With the present invention, the burn time of a synthetic firelog is increased. Further, the flames maintain their attractiveness for a longer duration because the synthetic log is less prone to break apart.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
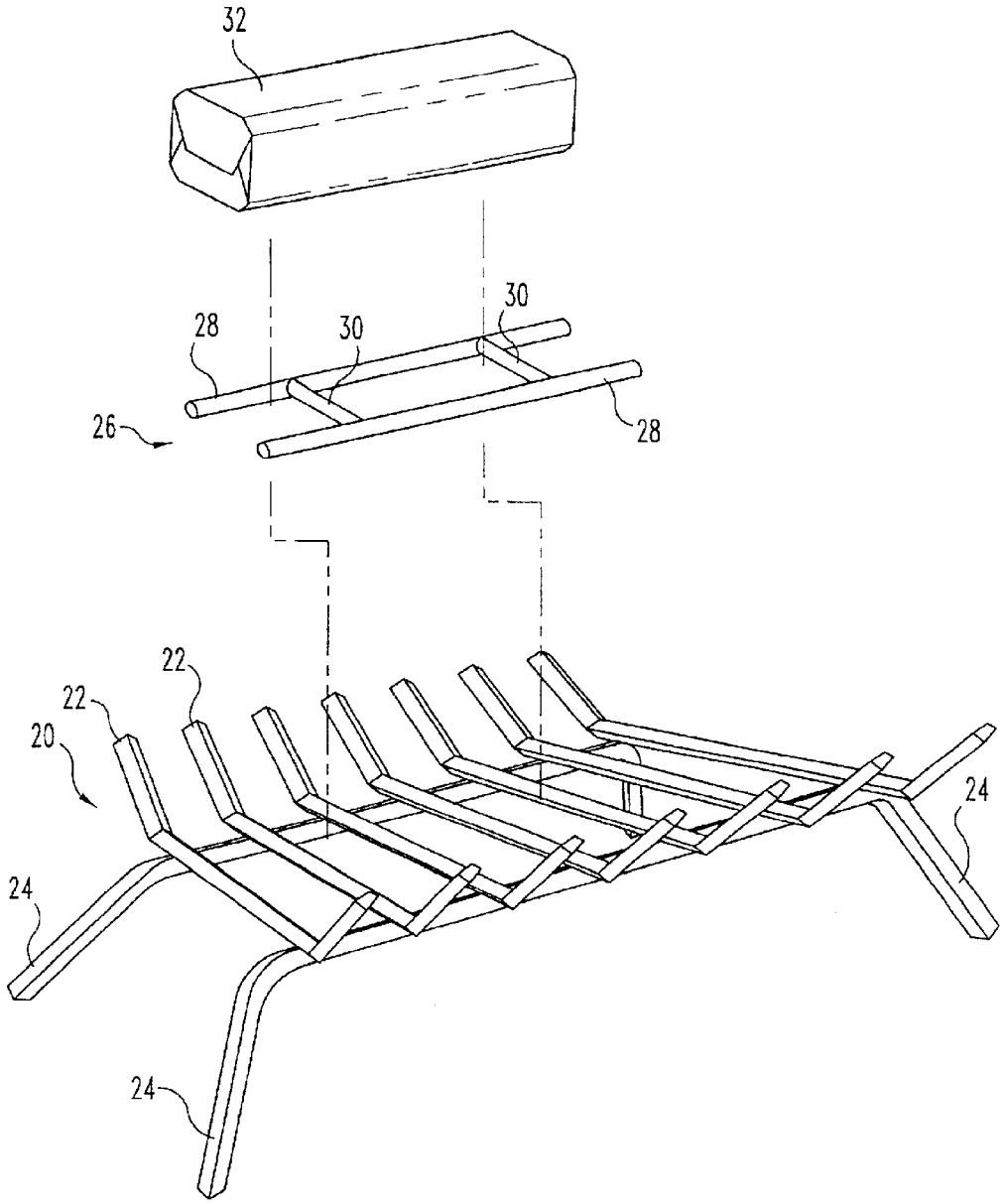
FIG. 1 is an exploded perspective view of a fireplace grate, a grate accessory in accordance with the present invention, and a synthetic fireplace log.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION

Figure 2:
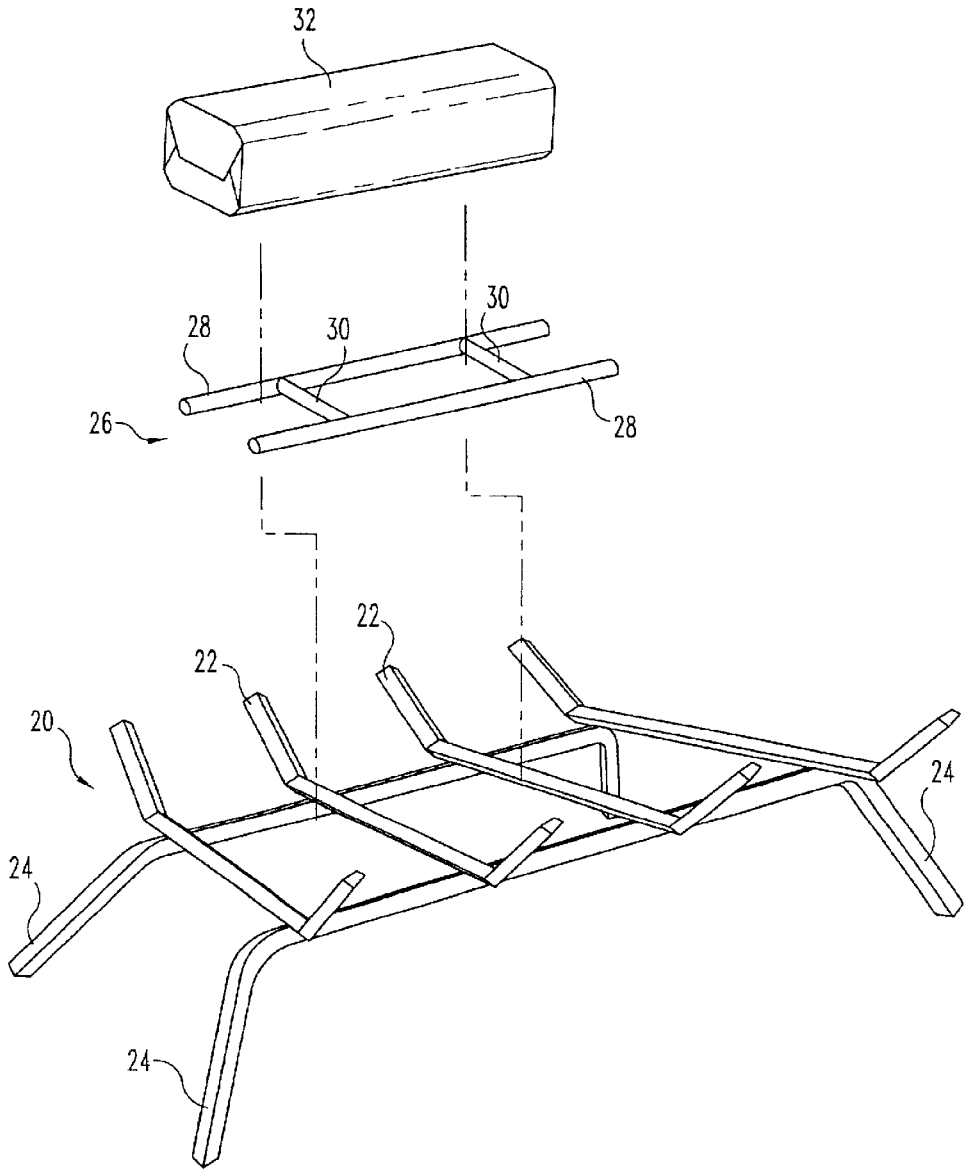
FIG. 2 is an exploded perspective view of another fireplace grate that is similar to the grate of FIG. 1 (except that the bars are spaced further apart), a grate accessory in accordance with the present invention, and a synthetic fireplace log.

Turning to FIGS. 1 and 2, fireplace grate 20 includes substantially parallel spaced bars 22 that are adapted for supporting a log made of real wood (not shown). Bars 22 can be spaced apart anywhere from 2 to 3 inches or more, measured center to center (compare FIGS. 1 and 2 for spacing differences). Four legs 24 extend downwardly from bars 22, thereby supporting the grate away from the fireplace floor on which it sits. A grate accessory 26 rests on top of grate 20 as indicated.

Accessory 26 includes two elongate members 28 that are positioned across a portion of bars 22. As shown in FIGS. 1 and 2, elongate members 28 are substantially parallel to one another. Members 28 are spaced apart and are connected to one another by connecting members 30. Connecting members 30 comprise a pair of spaced bars disposed between elongate members 28, the connecting members 30 being substantially orthogonal to elongate members 28 in the embodiment shown in FIGS. 1 and 2. It is envisioned that for most applications, accessory 26 need merely rest upon grate 20; however, clamps (not shown) may be provided with accessory 26 to removably attach the same to grate 20.

Problematically in the prior art, if a synthetic firelog, for example, one formed of an extrudate of petroleum wax and sawdust, such as that marketed under the trade mark Duraflame®, be placed on grate 20 and ignited, the maximum burn time of the log will likely not be achieved. Instead, the firelog will break into smaller pieces as it burns and the pieces will fall between bars 22. Such breakage will occur more quickly if a grate with larger spacing between its bars 22 (see FIG. 2) is used. The overall burn time of a synthetic log is reduced when it breaks into smaller pieces. By contrast, if accessory 26 is placed on bars 22 as indicated in FIGS. 1 and 2, and synthetic log 32 is placed thereon, log 32 will burn longer. This is believed to be the case because accessory 26 having elongate members 28 and connecting members 30 provides a better support for log 32 than the grate alone.

Figure 3:
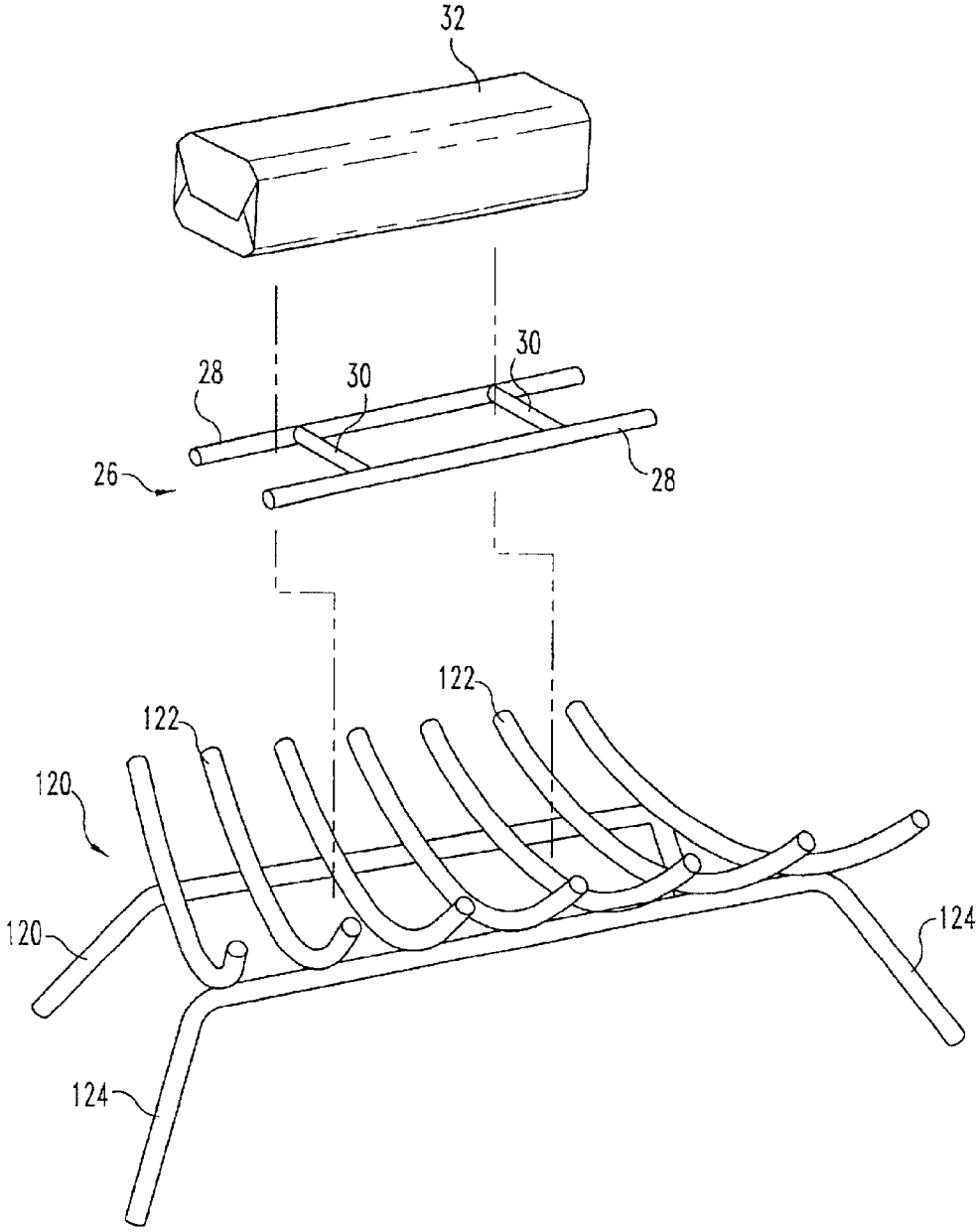
FIG. 3 is an exploded perspective view of yet another fireplace grate, a grate accessory in accordance with the present invention, and a synthetic fireplace log.
Figure 4:
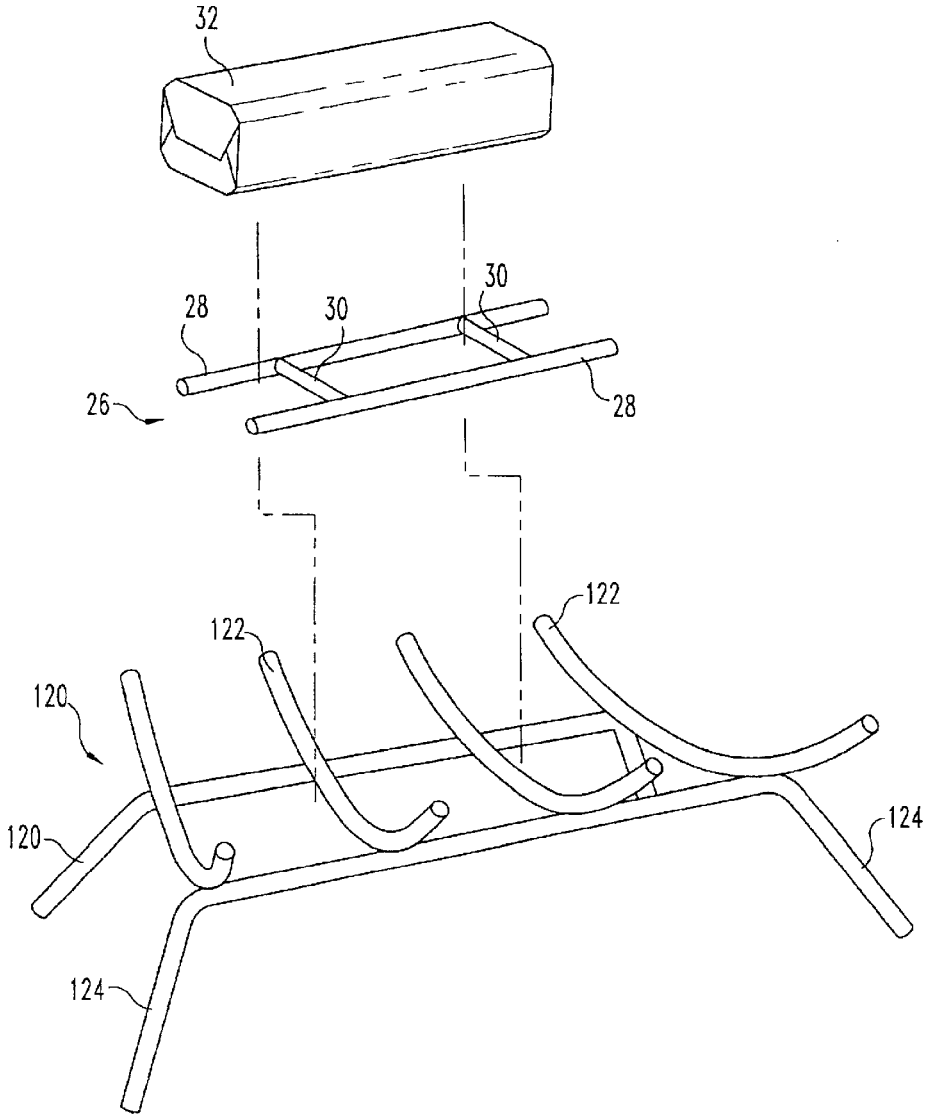
FIG. 4 is an exploded perspective view of another fireplace grate that is similar to the grate of FIG. 3 (except that the bars are spaced further apart), a grate accessory in accordance with the present invention, and a synthetic fireplace log.
Figure 5:
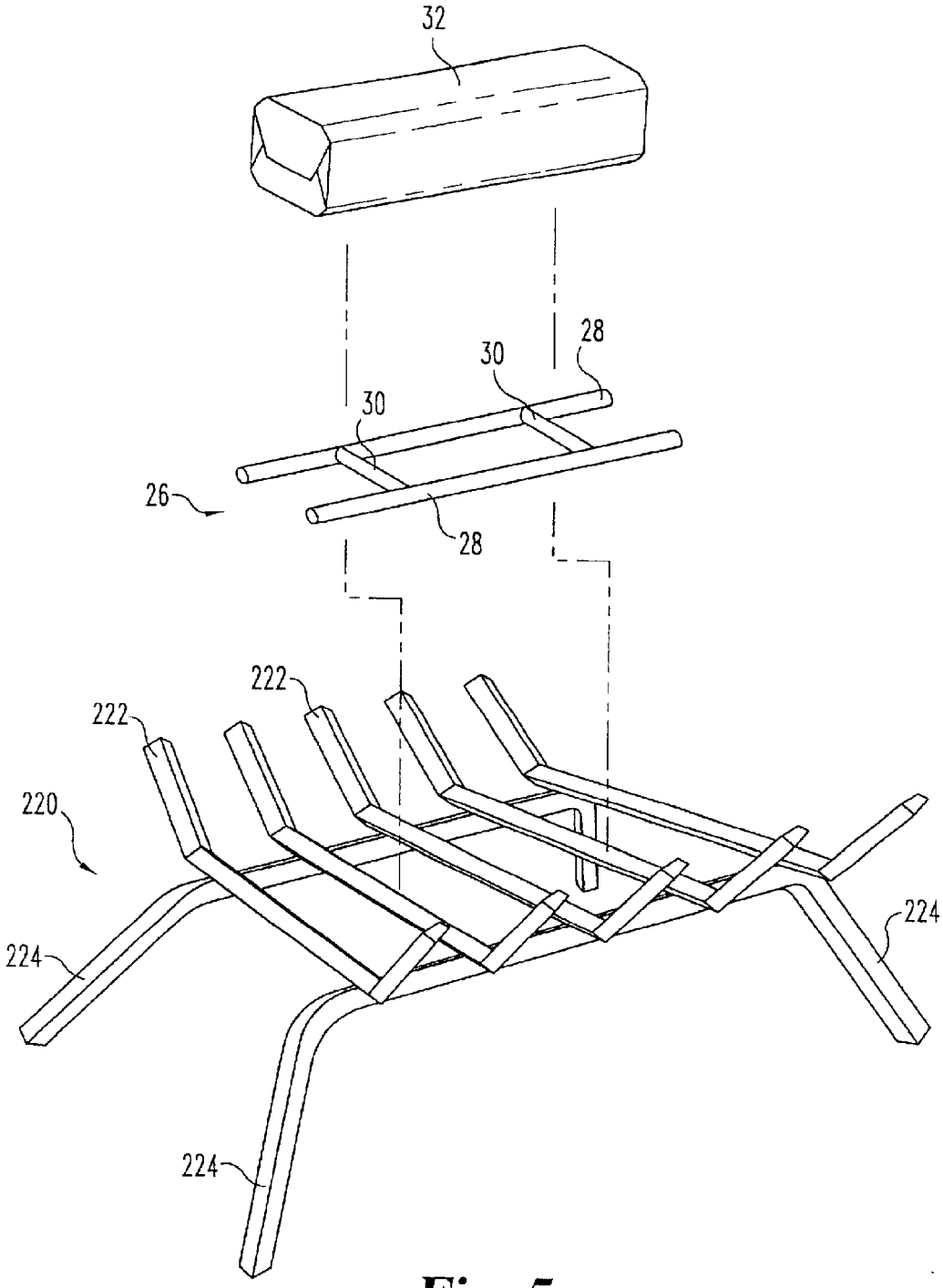
FIG. 5 is an exploded perspective view of yet another fireplace grate, a grate accessory in accordance with the present invention, and a synthetic fireplace log.

While grate accessory 26 is shown in FIGS. 1 and 2 with a 27 inch grate whose bars 22 are curved upward at each end, accessory 26 can be used with any of a variety of commercially available traditional fireplace grates. For example, FIGS. 3 and 4 depict accessory 120 having bars 122 that are substantially radially disposed. Similarly, FIG. 5 shows accessory 26 being used with a 23 inch grate 220 whose bars 222 are flat in the middle and bent upward at each end. Significantly, as the spaces between bars 22, 122 or 222 become greater (compare FIGS. 1 and 2; FIGS. 3 and 4), accessory 26 provides greater extension in the burn time of a synthetic log.

Figure 6:
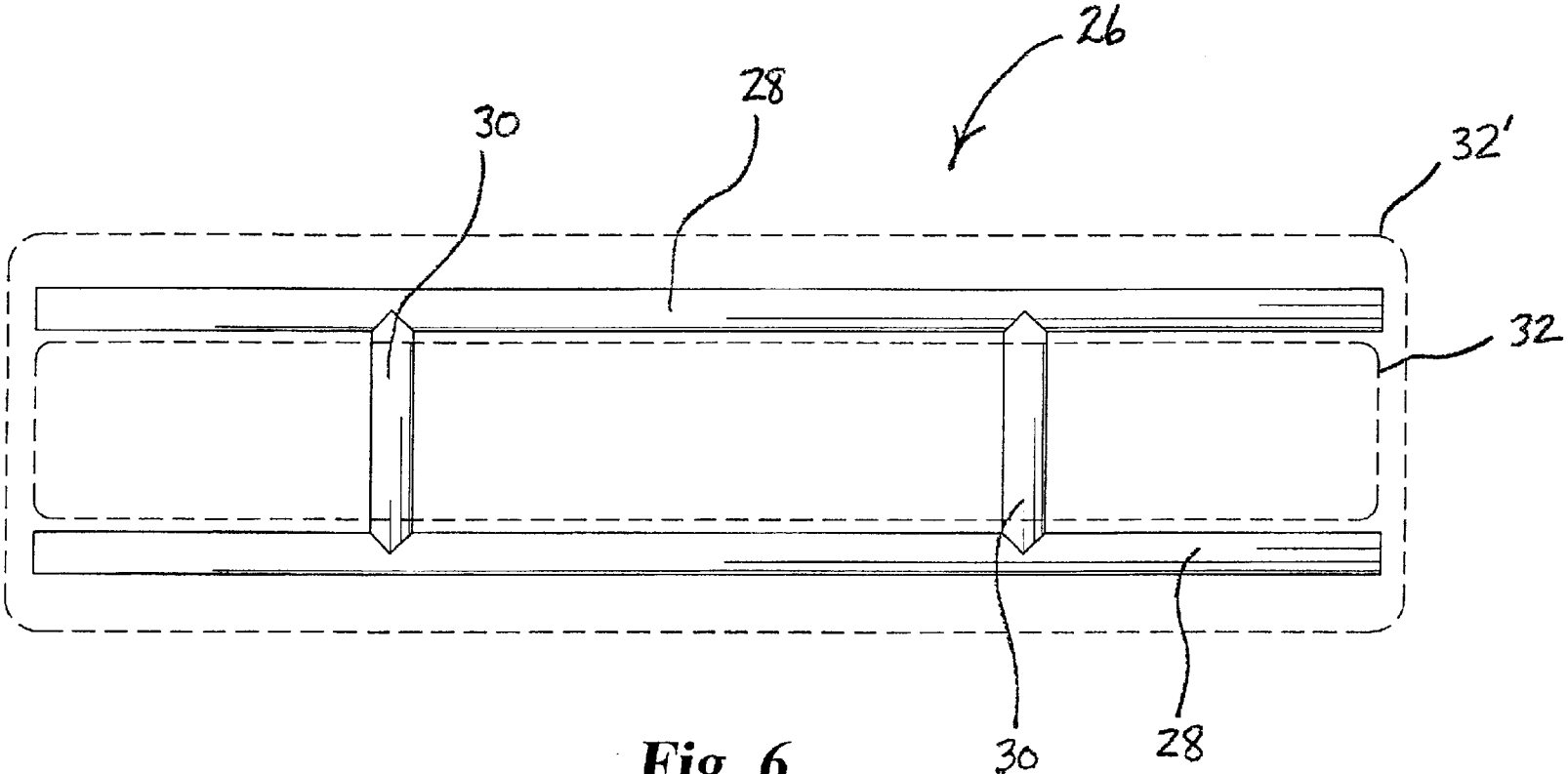
FIG. 6 is a top view of a grate accessory in accordance with the present invention, showing two differently sized firelogs in phantom.

Turning now to FIG. 6, grate 26 supports different sized firelogs 32 and 32', both of which are shown in phantom. It is preferable that elongate members 28 of grate accessory 26 are spaced to a width that is smaller than the width of the firelog 32'. In this manner, both elongate members 28 and connecting members 30 provide support for the firelog as it burns, thereby maximizing the time the log will burn without breaking and falling through the grate.

Figure 7:
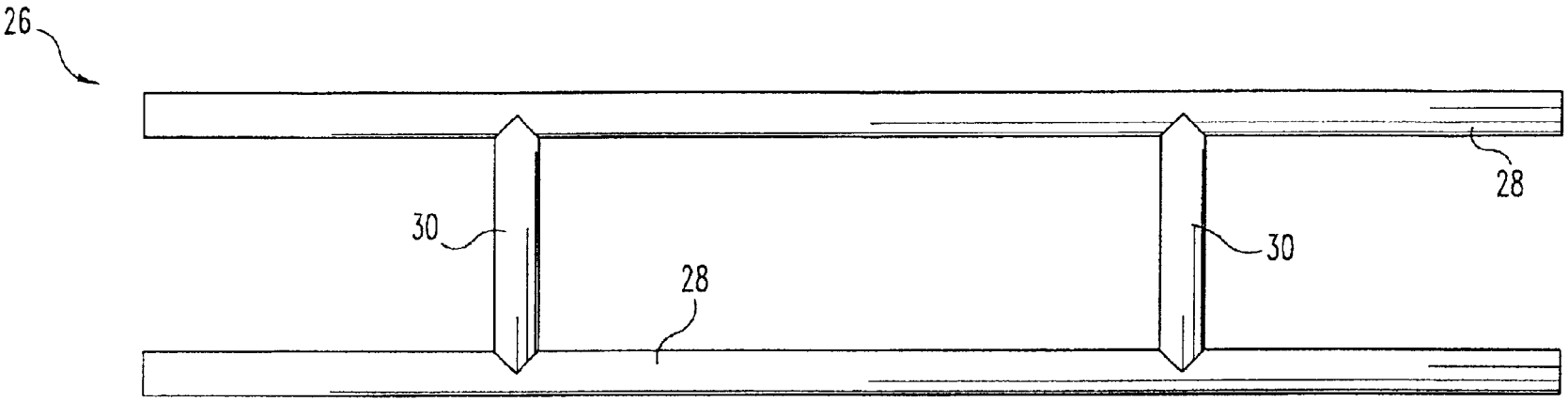
FIG. 7 is a top view of a grate accessory in accordance with the present invention.
Figure 8:
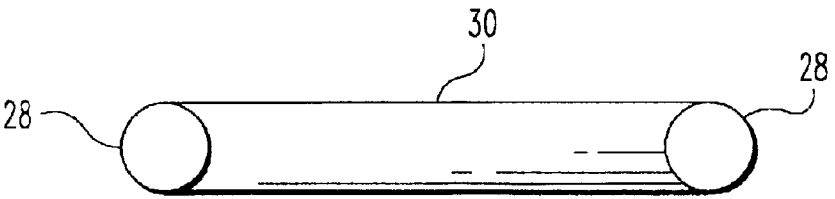
FIG. 8 is a fragmentary elevational view of a connecting member for a grate accessory in accordance with the present invention.

Turning now to FIGS. 7 and 8, the detailed structure of a preferred grate accessory of the present invention can be appreciated. Elongate members 28 are preferably formed from round ½ inch diameter commercially available steel stock. While ½ inch is the preferred diameter, it is anticipated that smaller or larger diameters may be employed with satisfactory results. Preferably the diameter of the steel (or iron) used to form accessory 26 would be between ⅜ inch and ⅞ inch. Welded to elongate members 28 and spacing same apart are connecting members 30 (shown more closely in FIG. 8), which are also formed of ½ inch diameter round steel.

It is to be understood that the dimensions described herein with reference to FIGS. 7 and 8 merely represent the preferred embodiment at the time this application was written. However, one of ordinary skill in the art may modify the dimensions and still achieve the desired result of increasing burn time of a synthetic log used on a conventional fireplace grate as depicted in FIGS. 1–5, or other conventional fireplace grates. Further, more than two connecting members 30 may be employed to connect the elongate members 28 of accessory 26.

The inventor of the present invention has conducted side-by-side comparison testing using identical synthetic firelogs on the same conventional fireplace grate, with and without grate accessory 26 of the present invention. Initial testing has shown that by using a grate accessory 26 as taught by the present invention, the burn time of a firelog is increased by at least 10 to 20 minutes, sometimes much longer. Further, the flames maintain their uniformity and attractiveness longer because the log is less prone to break apart.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A fireplace grate assembly, comprising:

a grate having substantially parallel spaced bars adapted for supporting a log;

a plurality of legs connected to said grate and extending downwardly therefrom, thereby supporting said grate away from a fireplace floor on which said grate is placed; and an accessory positioned on top of said grate, said accessory comprising two elongate members positioned across a portion of said parallel spaced bars, said elongate members being spaced apart and connected to one another by at least one connecting member, said at least one connecting member and said elongate members having a uniform cross section and diameter of between ⅜–⅞ inches, wherein the top of said accessory is spaced from said bars by said diameter.

2. The fireplace grate assembly of claim 1, wherein said elongate members are substantially parallel to one another.

3. The fireplace grate assembly of claim 2, wherein said connecting member comprises a pair of spaced bars disposed between said elongate member, said pair of spaced bars being substantially orthogonal to said elongate members.

4. The fireplace grate assembly of claim 1, wherein said elongate members comprise cylindrical steel stock of diameter between ⅜ inches to ⅞ inches and whose centers are spaced apart between 2½ to 3½ inches.

5. The fireplace grate assembly of claim 4, wherein said connecting member comprises a pair of spaced bars disposed between said elongate members, said pair of bars being substantially orthogonal to said elongate members and being formed from the same stock.

6. The fireplace grate assembly of claim 5, wherein said connecting members are welded to said elongate members.

7. The fireplace grate assembly of claim 1, wherein said parallel spaced bars are spaced at least 2.5 inches center to center.

8. The fireplace grate assembly of claim 1, wherein said parallel spaced bars of said grate form a gap of at least 2 inches therebetween, said connecting member positioned intermediate two of said bars.

9. The fireplace grate assembly of claim 1, wherein said connecting member comprises a pair of spaced bar members disposed between said elongate members, said pair of bar members being substantially orthogonal to said elongate members and being formed from the same stock.

10. The fireplace grate assembly of claim 9, further comprising a synthetic firelog resting on said accessory, said firelog having a rectangular or cylindrical shape and being supported by said elongate members and said pair of bars, whereby said firelog burns longer than if placed on said grate without said accessory.

* * * * *